US007628608B1

(12) United States Patent
Doyle et al.

(10) Patent No.: US 7,628,608 B1
(45) Date of Patent: Dec. 8, 2009

(54) SUBMERSIBLE GAS BURNER

(75) Inventors: James Doyle, Los Angeles, CA (US); Mark W. Fuller, Toluca Lake, CA (US); Russell Nave, Quartz Hill, CA (US); Ronald McGinnes, Little Rock, CA (US)

(73) Assignee: Wet Enterprises, Inc., Sun Valley, CA (US)

( * ) Notice: Subject to any disclaimer, the term of this patent is extended or adjusted under 35 U.S.C. 154(b) by 682 days.

(21) Appl. No.: 11/198,266

(22) Filed: Aug. 5, 2005

(51) Int. Cl.
*F23Q 9/00* (2006.01)

(52) U.S. Cl. ..... 431/278; 431/285; 137/599.01

(58) Field of Classification Search ..... 431/191, 431/48, 129–152, 278–285, 344; 126/271.1, 126/272.2 R, 360.1; 137/599.01; 239/12
See application file for complete search history.

(56) References Cited

U.S. PATENT DOCUMENTS 3,174,820 A * 3/1965 See et al. ..... 423/528
3,194,229 A * 7/1965 Borgeson ..... 126/373.1
3,501,255 A * 3/1970 Greene ..... 431/202
4,416,614 A * 11/1983 Moody ..... 431/278
5,961,042 A * 10/1999 Doyle ..... 239/12
6,131,819 A * 10/2000 Fuller et al. ..... 239/20
6,871,793 B2 3/2005 Ruments et al.

* cited by examiner

*Primary Examiner*—Kenneth B Rinehart
*Assistant Examiner*—Chuka C Ndubizu
(74) *Attorney, Agent, or Firm*—Blakely Sokoloff Taylor & Zafman

(57) ABSTRACT

A submersible gas burner includes a pilot burner, a closed gas reservoir, and a first and second main burners. The pilot burner has a pilot burner tube with a closed upper end, an open lower end and a pilot gas inlet adjacent the upper end. The pilot burner provides a downwardly directed pilot flame. The closed gas reservoir has an upper end, a lower end, and a main gas inlet above the lower end. The main burners are coupled to the gas reservoir with upper ends adjacent the pilot burner and opposing lower ends coupled to the gas reservoir. The lower end of the first main burner is further from the lower end of the gas reservoir than the main gas inlet while the lower end of the second main burner is closer to the lower end of the gas reservoir than the main gas inlet.

13 Claims, 5 Drawing Sheets

SUBMERSIBLE GAS BURNER

BACKGROUND OF THE INVENTION

Decorative water displays may be provided as a visual focal point in a variety of settings. Such displays may be used to provide dramatic displays with entertainment value. The display may incorporate highly dynamic interactions of water, light, and other elements to produce unique displays capable of holding a viewers interest for extended periods of time. It may be desirable to add fire elements to such water displays to provide a dramatic contrast between the fire and water.

In particular, it may be desirable to have a device that can produce fireballs in rapid succession with accurate timing to allow the fireballs to be choreographed as part of a kinetic display. It may be desirable to submerge the device in a pool of water to hide the device from viewers and to elevate the device only when the device is to be used. Further, it may be desirable to elevate only a minimal portion of the device so that the device does not intrude into the visual display. It may be desirable that the device operate reliably upon being raised from the submerged position and in the presence of deluging sprays of water or waves in the pool of water.

SUMMARY OF THE INVENTION

A submersible gas burner includes a pilot burner, a closed gas reservoir, and a first and second main burners. The pilot burner has a pilot burner tube with a closed upper end, an open lower end and a pilot gas inlet adjacent the upper end. The pilot burner provides a downwardly directed pilot flame. The closed gas reservoir has an upper end, a lower end, and a main gas inlet above the lower end. The main burners are coupled to the gas reservoir with upper ends adjacent the pilot burner and opposing lower ends coupled to the gas reservoir. The lower end of the first main burner is further from the lower end of the gas reservoir than the main gas inlet while the lower end of the second main burner is closer to the lower end of the gas reservoir than the main gas inlet.

DETAILED DESCRIPTION OF THE INVENTION

Figure 1:
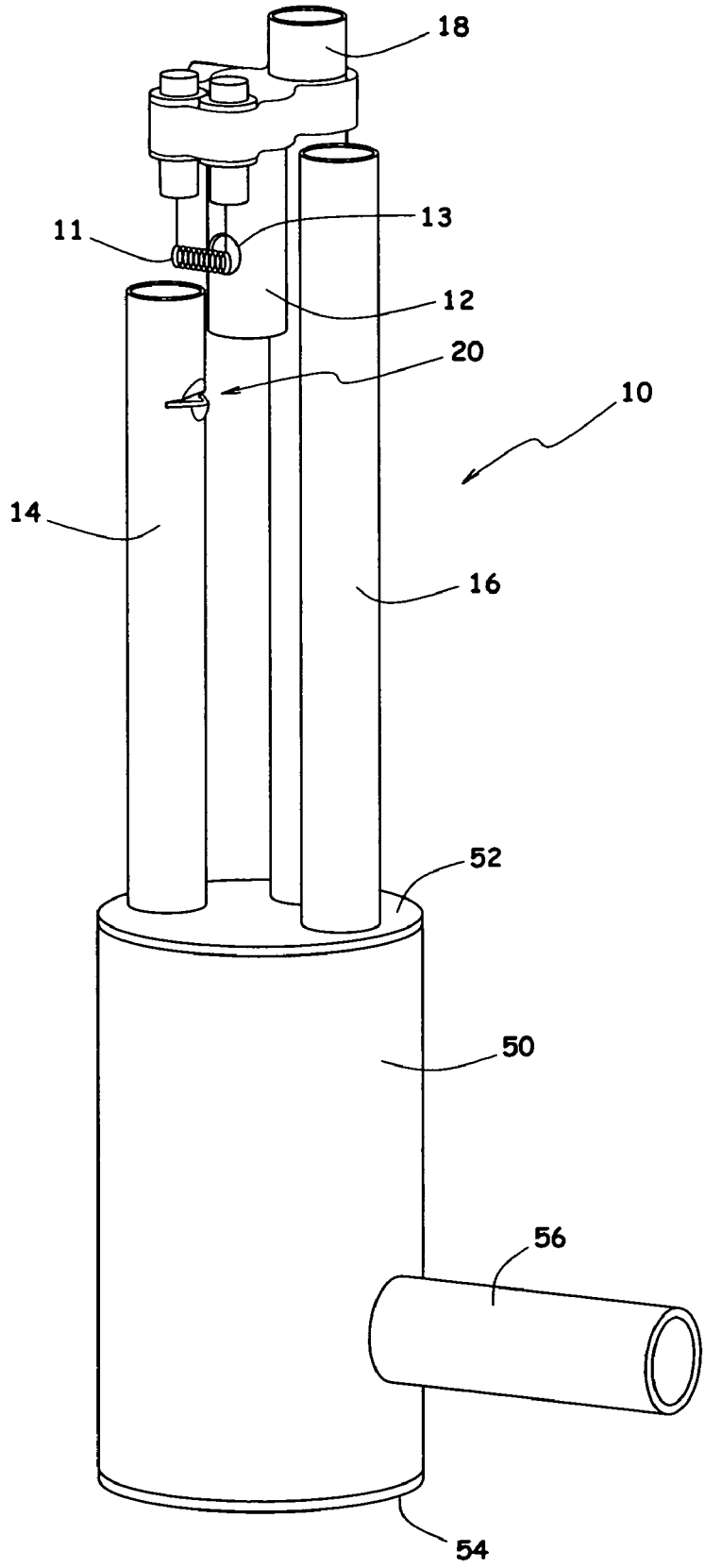
FIG. 1 is a pictorial view of a submersible gas burner that embodies the invention.

FIG. 1 is a pictorial view of a submersible gas burner that embodies the invention. The submersible gas burner 10 may be submerged under water and then elevated fully or partially above the surface of the water and ignited shortly after being elevated. The burner 10 may be operated in the presence of water under deluge conditions. Deluge conditions may mean that the burner is subject to brief periods of total immersion in water while operational, such as being drenched by water waves.

For the purposes of this application, the directions of up and down are used to describe the orientation of the burner in its operational orientation. Down is direction in which objects move under the influence of gravity and up is the opposite direction. This up-down orientation is significant to the operation of the submersible gas burner because certain operational aspects of the device may rely on the tendency of water to flow down the device and gas to rise up in both water and air.

Figure 3:
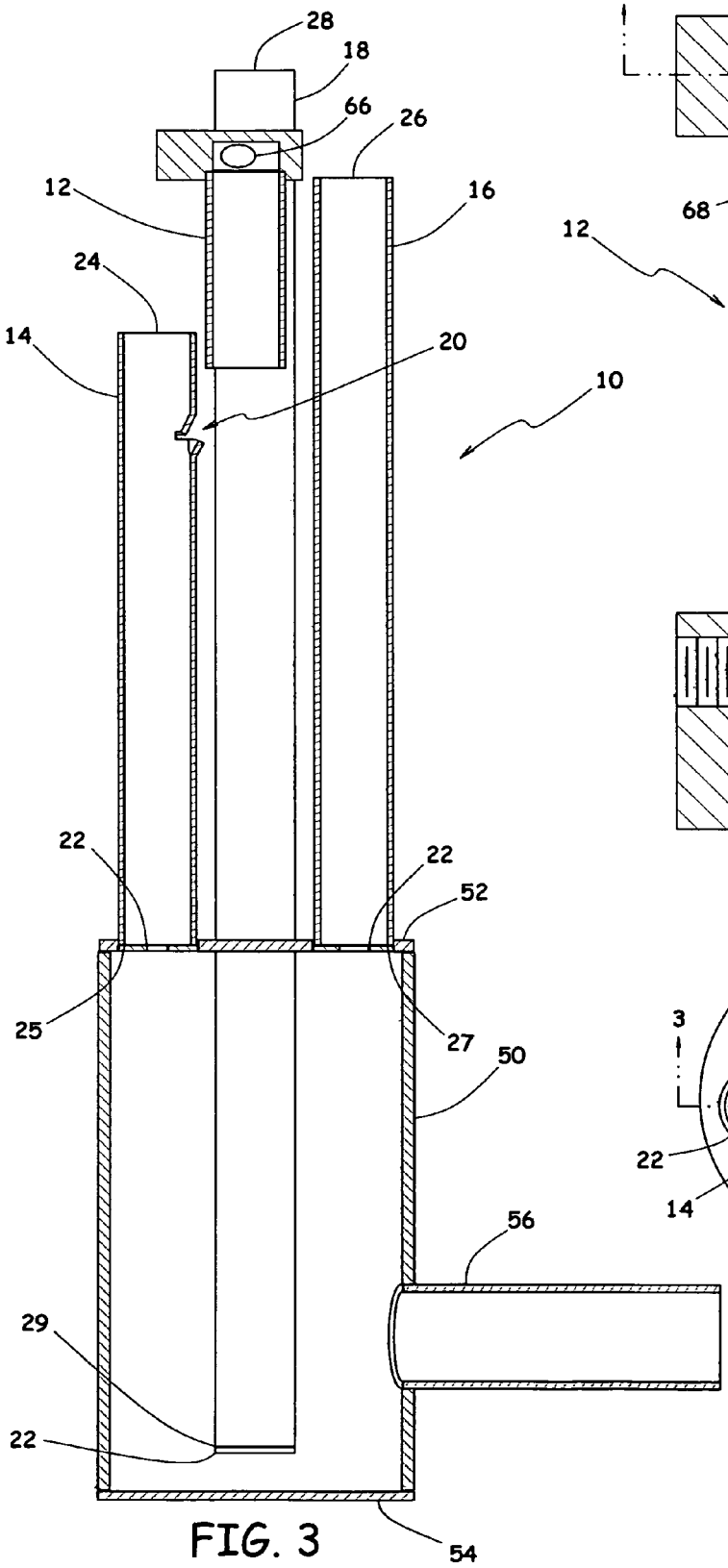
FIG. 3 is a section view of the submersible gas burner taken along section line 3-3 of FIG. 2.
Figure 4:
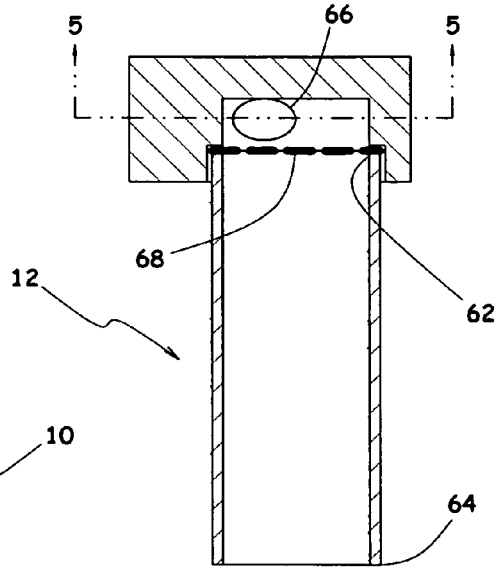
FIG. 4 is an enlarged detail from FIG. 3.
Figure 2:
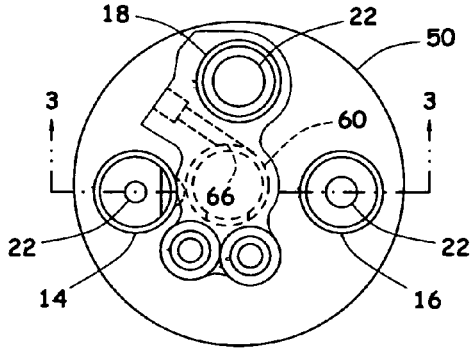
FIG. 2 is a top view of the submersible gas burner of FIG. 1.

The submersible gas burner 10 includes a pilot burner 12, a closed gas reservoir 50, a first main burner 14 and a second main burner 18. FIG. 2 is a top view of the submersible gas burner 10. FIG. 3 is a section view of the submersible gas burner 10 taken along section line 3-3 of FIG. 2. As best seen in FIG. 4, an enlarged detail from FIG. 3, the pilot burner 12 has a pilot burner tube 60 with a closed upper end 62, an open lower end 64, and a pilot gas inlet 66 adjacent the upper end 62. The pilot burner 12 provides a downwardly directed pilot flame.

The closed gas reservoir 50 has an upper end 52, a lower end 54, and a main gas inlet 56 above the lower end. The main burners 14, 16, 18 are coupled to the gas reservoir 50 with upper ends 24, 26, 28 adjacent the pilot burner 12. Adjacent is used to mean that the upper ends are in the general vicinity of the pilot burner in a configuration that is conducive to ignition of gas emitted from the main burners by the pilot burner, either directly by the pilot burner or indirectly by another main burner that was ignited by the pilot burner. The opposing lower ends 25, 27, 29 of the main burners 14, 16, 18 are coupled to the gas reservoir 50. The lower end 25 of the first main burner 14 is further from the lower end 54 of the gas reservoir 50 than the main gas inlet 56 while the lower end 29 of the second main burner 18 is closer to the lower end 54 of the gas reservoir 50 than the main gas inlet 56.

Providing a downwardly directed pilot flame from the pilot burner 12 may allow the pilot flame to be maintained under deluge conditions. Distributing gas from a main gas inlet 56 through a coupled gas reservoir 50 may allow water that enters the main burners 14, 16, 18 to be purged while the burner assembly continues to function. If water enters a main burner it may collect at the lower end 54 of the gas reservoir 50. Gas will continue to flow from the main gas inlet 56 to a main burner 14 coupled to the gas reservoir 50 where the lower end 25 of the burner is further from the lower end 54 of the gas reservoir than the main gas inlet.

Simultaneously, accumulated water in the gas reservoir 50 may be discharged through a second main burner 18 coupled to the gas reservoir where the lower end 29 of the second main burner is closer to the lower end 54 of the gas reservoir than the main gas inlet 56. The main burners 14, 16, 18 may include orifice plates 22, such as those shown at the lower ends of the burners, to control the velocity of gas emitted by the burners. It will be appreciated that the velocity of the gas must be less than the flame propagation velocity for the burner to operate successfully. The orifices 22 may be of different sizes, as shown, to provide a composite gas stream with a desired flame propagation effect. The second main burner 18 used to discharge accumulated water may have a larger orifice 22 than the one or more burners 14, 16 used for burning when water accumulates in the gas reservoir 50. The difference in orifice sizes may create a pressure in the gas reservoir 50 that may help to discharge accumulated water through the second main burner 18 with its larger orifice 22. It will be appreciated that there may be one or more first main burners with lower ends above the main gas inlet and one or more second main burners with lower ends below the main gas inlet.

As shown in FIG. 1, the pilot burner 12 may provide an ignition port 13 in the side wall of the pilot burner tube. The ignition port 13 may face an ignition device such as a glow coil 11, as shown. Other ignition devices such as a sparking device may also be used.

Figure 5:
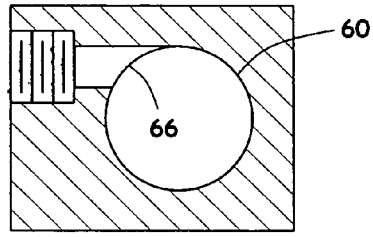
FIG. 5 shows a cross-section of the pilot burner taken along section line 5-5 of FIG. 4

FIG. 4 shows the cross-section of the pilot burner 12 of FIG. 3 in greater detail. FIG. 5 shows a cross-section of the pilot burner 12 taken along section line 5-5 of FIG. 4; it will be appreciated that the outer shape of the section has been simplified. The pilot gas inlet 66 is substantially tangential to the periphery of the pilot burner tube 60. Substantially tangential means that the gas inlet directs the pilot gas along the wall of the pilot burner tube 60 generally perpendicular to the axis of the pilot burner tube. This may impart a swirling motion to the gas in the pilot burner tube and the resulting pilot flame. A swirling motion may improve the stability of the pilot flame.

The pilot burner 12 may further include a burner grid 68 parallel to the closed upper end of the pilot burner tube and below the pilot gas inlet. The burner grid 68 may provide a stable base for the pilot flame.

The first main burner 14 may include a gas diversion opening 20 in the side of the first main burner adjacent the pilot burner 12. Preferably the gas diversion opening 20 will be positioned as shown such that a stream of gas is diverted from the main burner 14 toward the flame provided by the pilot burner 12 to create a secondary pilot flame when the main burners are supplied with gas through the main gas inlet 56 and gas reservoir 50. While tubular burners are described and illustrated, it will be appreciated that the burners of other forms may be used in other embodiments of the invention. For example, an annular main burner may be used with the pilot burner located inside the annulus. A gas diversion opening may be provided on the inner wall of the annulus.

Figure 6:
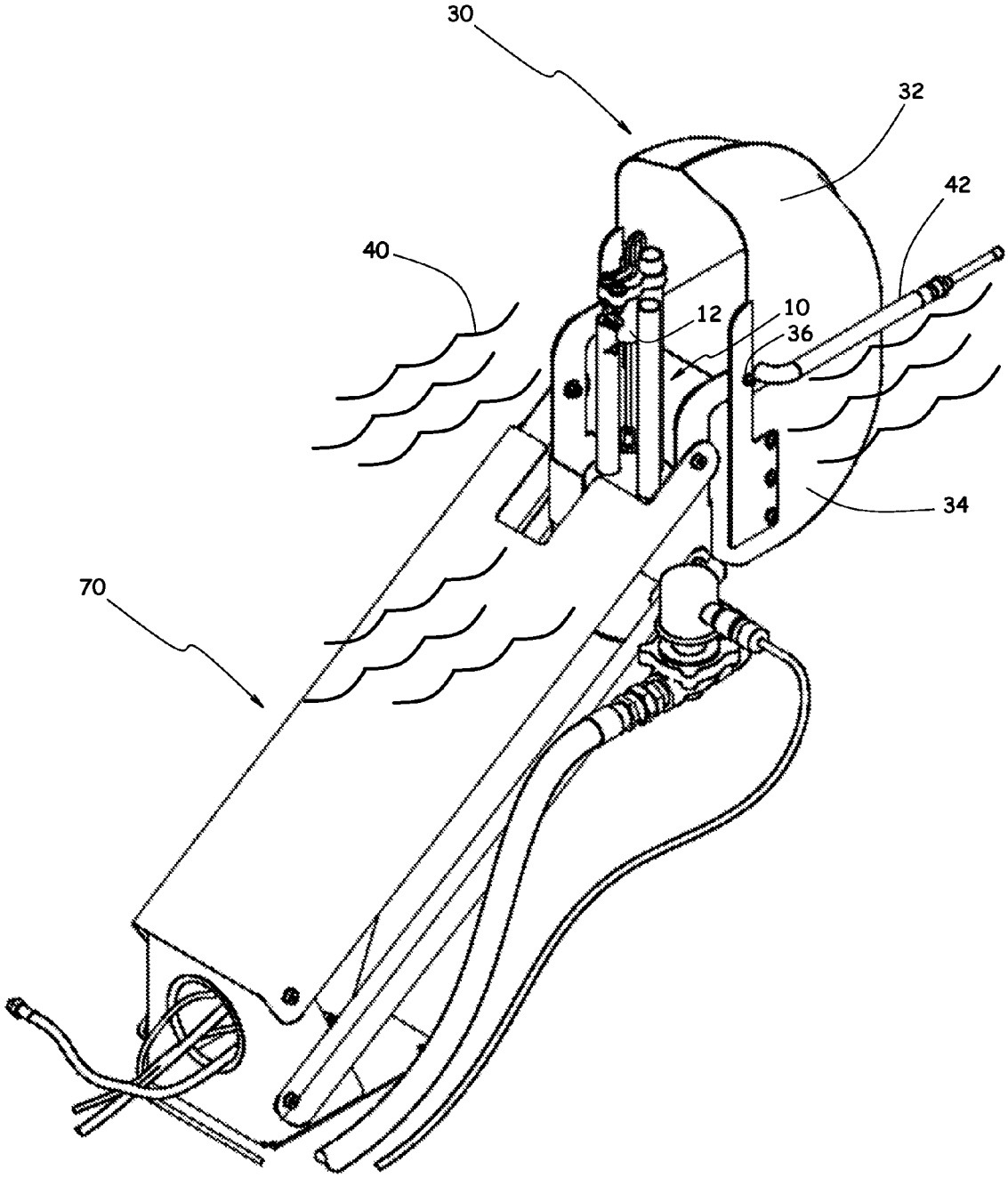
FIG. 6 is a pictorial view of a device that embodies the invention.

FIG. 6 is a pictorial view of a device that embodies the invention. A hood assembly 30 may be pivotally mounted to the gas burner 10 by a pivot assembly 36. The hood assembly 30 may provide a hood 32 that is movable between a first position in which the hood covers the open ends of the pilot burner 12 and the main burners 14, 16, 18 to prevent the entry of water when the gas burner 10 is submerged as shown in the side view of FIG. 7 and a second position in which the hood is clear of the gas burner to permit ignition of the main burners as shown in the side view of FIG. 8.

Figure 7:
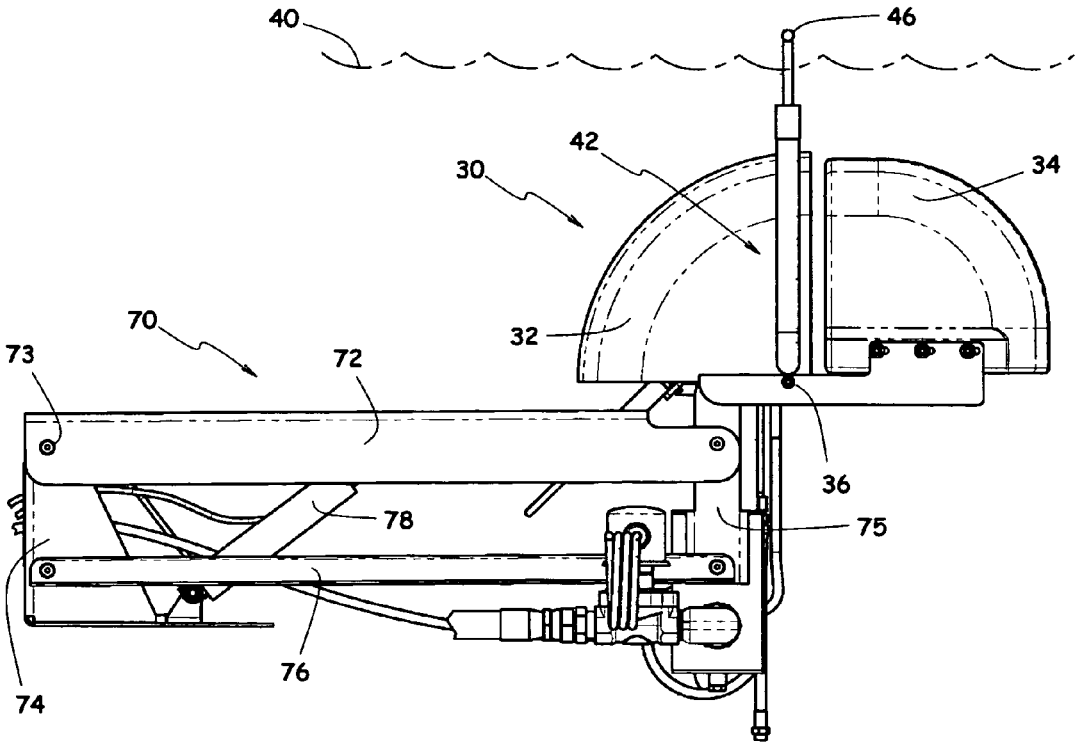
FIG. 7 is a side view of the device of FIG. 6 in a first position.

As seen in FIG. 7, the hood assembly 30 may move to a closed position covering the burner assembly 10 when the burner assembly is below a surface 40 of a pool of water in which the device is submerged. The hood 32 may provide an air space surrounding the pilot burner 12 and the upper portion of the burner assembly 10 when the burner assembly is below the surface 40 of the pool of water. The hood may allow the pilot burner to be ignited and a pilot flame maintained while the burner assembly is below the surface 40 of the water. The hood may also discourage the incursion of water into the burner assembly so that it can be ignited shortly after being elevated above the surface 40 of the water to a position such as that shown in FIG. 8. A float 34 may be coupled to the hood such that the float causes the hood 32 to move to the first position when the gas burner is submerged and to the second position when the gas burner is not submerged.

Figure 8:
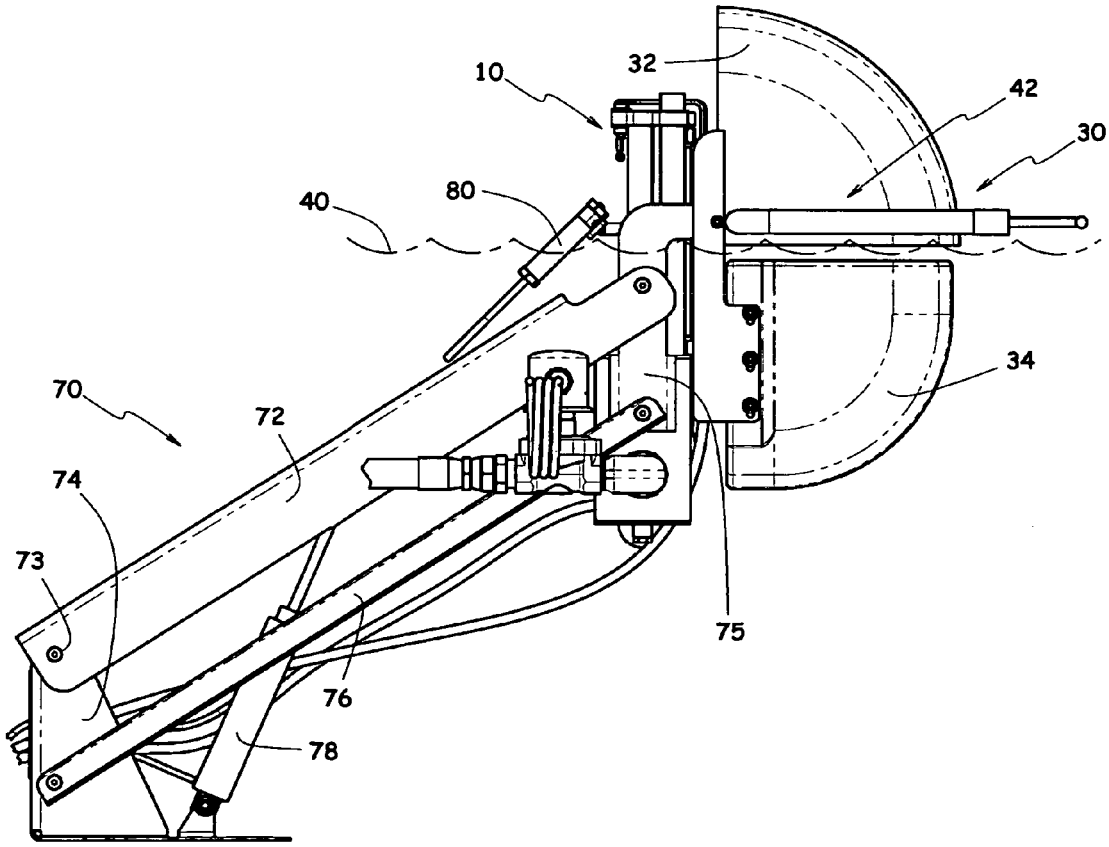
FIG. 8 is a side view of the device of FIG. 6 in a second position.

The device may include a pilot flame detector to verify that the pilot flame is lit. For example, an infrared detector 80 is shown in FIG. 8. Other types of pilot flame detection such as a thermocouple or thermistor may also be used. The pilot flame detector may prevent the admission of gas to the main burners 14, 16, 18 if a pilot flame is not detected. The pilot flame detector may initiate an attempt to relight the pilot burner 12 if a pilot flame is not detected.

Figure 9:
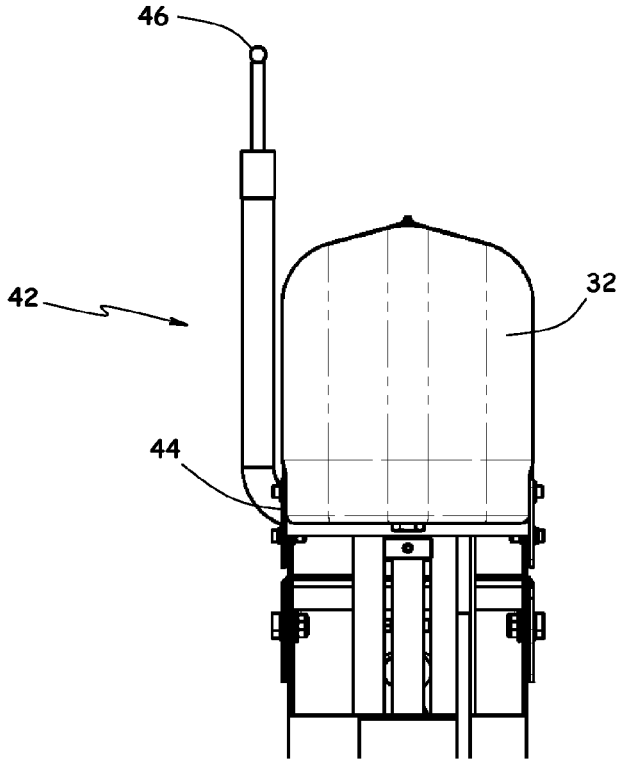
FIG. 9 is an end view of the hood shown in FIGS. 6-8.

As shown in the end view of FIG. 9, the hood 32 may include an exhaust snorkel 42 having a lower end 44 coupled to the hood and an upper end having a valve 46. The exhaust snorkel 42 may permit venting of exhaust gases when the pilot burner 12 is ignited while the hood 32 is in the first position. The valve may open when the exhaust gases are under pressure and close when the pressure is relieved and thereby discourage the entry of water into the volume enclosed by the hood 32.

Figure 11:
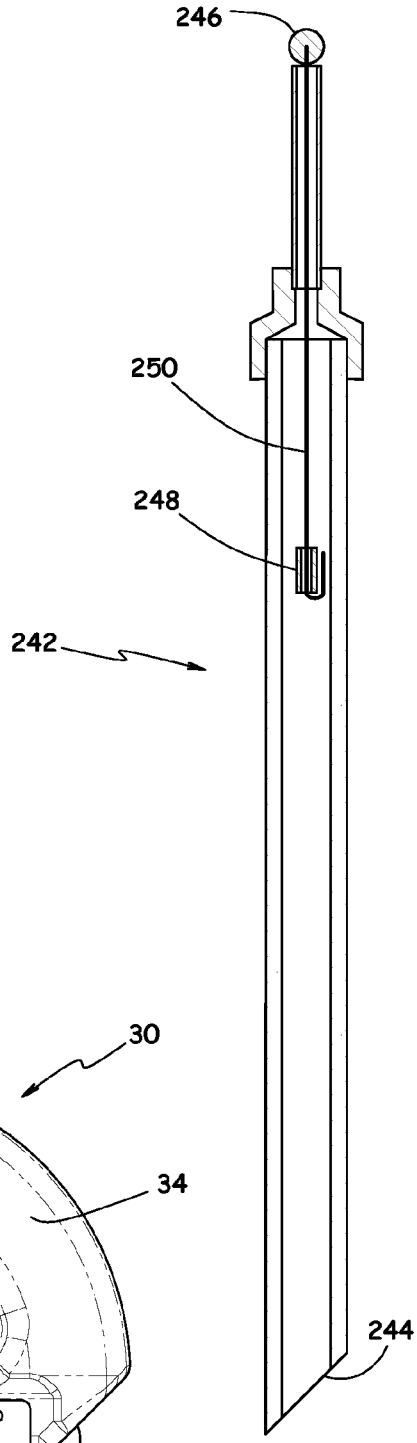
FIG. 11 is a section view taken along the diameter of an exhaust snorkel similar to the one shown in FIG. 10.
Figure 10:
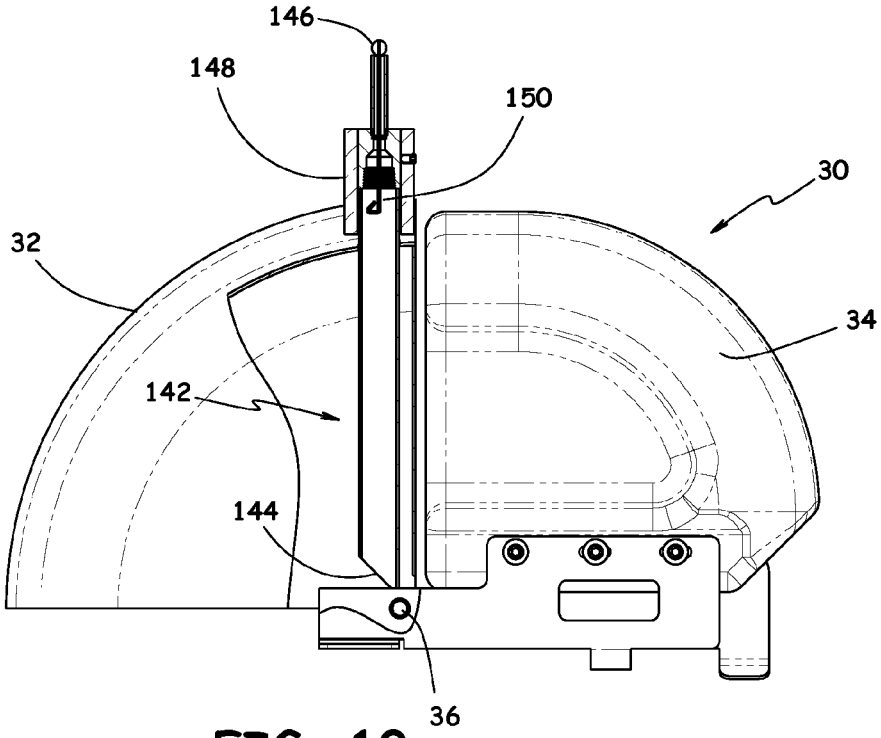
FIG. 10 is an cross section of the hood with another exhaust snorkel that embodies the invention.

FIG. 10 is an end view of an alternate embodiment of the exhaust snorkel 142. In this embodiment a midpoint of the exhaust snorkel 142 is coupled to the hood 32 at the top of the hood. FIG. 11 is a section view taken along the diameter of a similar exhaust snorkel 242. The exhaust snorkels 142, 242 of FIGS. 10-11 include a tube with an open lower end 144, 244 that may be angled. The tube may pass through the wall of the hood 32 near the top and be positioned adjacent the open bottom portion of the hood such that gases are exhausted from the hood through the snorkel rather under the edge of the hood when the hood is closed over the burner.

The valve 146, 246 may be a ball that closes the upper end of the exhaust snorkel when there is a relatively low pressure in the hood 32. A weight 148 may be suspended from the valve 146 inside the exhaust snorkel 142 to retain the valve to the exhaust snorkel and to determine the amount of pressure required in the hood 32 to open the valve. The weight 148 may be suspended by a device, such as a wire 150, that fits within the exhaust snorkel 142 without unduly reducing the area for exhaust flow. Preferably the valve 146 will be opened by the pressure of the exhaust gases before sufficient pressure develops in the hood 32 to cause gas to escape from the bottom of the hood and close before the pressure in the hood is low enough to permit the incursion of water through the exhaust snorkel. Thus the exhaust snorkel 142 with its valve 146 may provide for venting exhaust gases when the pilot burner 12 is ignited and the hood 32 is covering the gas burner 10 and for preventing entry of water into the volume enclosed by the hood.

It may be desirable to provide a ballast weight 148 on the hood assembly 30 to achieve a reliable opening and closing action as the burner assemble is raised and lowered in the water. The amount and location of the ballast will depend on the construction of the hood assembly, particularly the buoyancy provided by the float 34, the location of the pivot 36, and the weight of the hood 32. It may be possible to attach the ballast weight 148 to the exhaust snorkel 142 as shown.

As shown in FIG. 6, the burner assembly 10 may be mounted to an elevator mechanism 70 that can controllably raise and lower the burner assembly 10. The elevator mechanism 70 shown in FIGS. 6-8 is in the form of an arm 72 connected to a base 74 by a pivot 73. A burner support 75 is pivotally connected to the arm 72. A stabilizing link 76 connects the burner support 75 to the base 74 in a parallelogram arrangement to maintain the burner assembly 10 in a consistent orientation as the elevator mechanism is raised and lowered. A pneumatic actuator 78 may be used to raise and lower the arm 72 and the attached burner assembly 10. It will be appreciated that an elevator mechanism of any of a variety of forms, such as a directly actuating vertically oriented pneumatic cylinder, may be used in other embodiments of the invention.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A submersible gas burner comprising:

a pilot burner having a pilot burner tube with a closed upper end and an open lower end and a pilot gas inlet adjacent the upper end, the pilot burner adapted to provide a downwardly directed pilot flame;

a closed gas reservoir with an upper end, a lower end, and a main gas inlet above the lower end;

a first main burner coupled to the gas reservoir, the first main burner having an upper end adjacent the pilot burner and an opposing lower end coupled to the gas reservoir further from the lower end of the gas reservoir than the main gas inlet; and a second main burner coupled to the gas reservoir, the second main burner having an upper end adjacent the pilot burner and an opposing lower end coupled to the gas reservoir closer to the lower end of the gas reservoir than the main gas inlet.

2. The submersible gas burner of claim 1 wherein the pilot gas inlet is substantially tangential to the periphery of the pilot burner tube.

3. The submersible gas burner of claim 2 wherein the pilot burner further includes a burner grid parallel to the closed upper end of the pilot burner tube and below the pilot gas inlet.

4. The submersible gas burner of claim 1 wherein the first main burner includes a gas diversion opening in the side of the first main burner adjacent the pilot burner.

5. The submersible gas burner of claim 1 further comprising:

a hood pivotally mounted to the gas burner such that the hood is movable between a first position in which the hood covers the open ends of the pilot burner and the main burners to prevent the entry of water when the gas burner is submerged and a second position in which the hood is clear of the gas burner when ignited; and a float coupled to the hood such that the float causes the hood to move to the first position when the gas burner is submerged and to the second position when the gas burner is not submerged.

6. The submersible gas burner of claim 5 wherein the hood further includes an exhaust snorkel coupled to the hood, the exhaust snorkel having an open lower end and an upper end having a valve, the exhaust snorkel adapted to permit venting of exhaust gases when the pilot burner is ignited while the hood is in the first position, the valve adapted to open when the exhaust gases are under pressure and to close when the pressure is relieved and thereby discourage the entry of water into the volume enclosed by the hood.

7. The submersible gas burner of claim 1 further comprising an elevating mechanism coupled to the gas burner, the elevating mechanism adapted to raise and lower the gas burner while maintaining the orientation of the gas burner.

8. A submersible gas burner comprising:

pilot burner means for providing a downwardly directed pilot flame;

gas reservoir means for distributing gas from a main gas inlet;

a plurality of main burner means for burning gas from the gas reservoir means, at least one of the plurality of main burner means further for discharging water from the gas reservoir means;

hood means for preventing the entry of water into the pilot burner means and the plurality of main burner means when the gas burner is submerged; and float means coupled to the hood means for moving the hood when the gas burner is submerged.

9. The submersible gas burner of claim 8 wherein the pilot burner means includes pilot gas inlet means for imparting a swirling motion to gas in the pilot burner means.

10. The submersible gas burner of claim 9 wherein the pilot burner means further includes burner grid means for providing a stable base for a pilot flame.

11. The submersible gas burner of claim 8 wherein at least one main burner means includes gas diversion means for directing gas toward the pilot burner means.

12. The submersible gas burner of claim 8 wherein the hood means further includes exhaust means for venting exhaust gases when the pilot burner means is ignited and the hood means is covering the gas burner and for preventing entry of water into the volume enclosed by the hood means.

13. The submersible gas burner of claim 8 further comprising elevating mechanism means for raising and lowering the gas burner while maintaining the orientation of the gas burner.

* * * * *

UNITED STATES PATENT AND TRADEMARK OFFICE

CERTIFICATE OF CORRECTION

PATENT NO. : 7,628,608 B1
APPLICATION NO. : 11/198266
DATED : December 8, 2009
INVENTOR(S) : Doyle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1047 days.

Signed and Sealed this

Second Day of November, 2010

David J. Kappos

David J. Kappos
*Director of the United States Patent and Trademark Office*